United States Patent [19]

Shaffer et al.

[11] 4,448,255

[45] May 15, 1984

[54] ROTARY BLOWOUT PREVENTER

[76] Inventors: Donald U. Shaffer, 2850 E. Coronado St., Anaheim, Calif. 92806; Gary M. Oulrey, 540 Traffic Way, Arroyo Grande, Calif. 93420

[21] Appl. No.: 408,764

[22] Filed: Aug. 17, 1982

[51] Int. Cl.[3] ..... E21B 33/06

[52] U.S. Cl. ..... 166/387; 251/1 B; 277/31; 175/195; 166/84

[58] Field of Search ..... 277/31; 166/84, 387, 166/373; 175/195; 251/1 R, 1 B, 62, 63.4

[56] References Cited

U.S. PATENT DOCUMENTS

| | | | |
|---|---|---|---|
| 2,051,261 | 8/1936 | MacClatchie | 277/31 |
| 2,731,281 | 1/1956 | Knox | 277/31 |
| 3,023,012 | 2/1962 | Wilde | 277/31 |
| 3,128,614 | 4/1964 | Auer | 64/23.5 |
| 3,492,007 | 1/1970 | Jones | 277/31 |
| 3,587,734 | 1/1971 | Shaffer | 277/31 |
| 4,098,341 | 7/1978 | Lewis | 251/1 B |

*Primary Examiner*—Ernest R. Purser
*Assistant Examiner*—Michael Starinsky
*Attorney, Agent, or Firm*—Poms, Smith, Lande & Rose

[57] ABSTRACT

A rotary blowout preventer having a radially compressible packing to be sealingly engaged with and rotated by a drill pipe or kelly and a hydraulically actuated wedging piston for compressing the packing is provided with a rotatable bearing support which in an exemplary embodiment includes an inverted truncated cone interposed between the packing and the piston, which is rotatably mounted to the piston by a plurality of bearing races, along with a thrust bearing interposed between the packing and the housing enable the packing to rotate relative to the housing and prevents upward axial motion of the packing.

14 Claims, 5 Drawing Figures

ROTARY BLOWOUT PREVENTER

FIELD OF THE INVENTION

This invention relates in general to rotating blowout preventers for sealing off oil well pressures about rotating drill pipe or tools. More particularly, the present invention relates to an improved blowout preventer utilizing conventional stationary blowout preventer components in conjunction with a bearing means and packing contractor means for engaging a rotating seal about a rotating drill pipe or tool.

BACKGROUND OF THE INVENTION

In conventional oil well drilling operations, a drill bit is attached to the lower end of a drill pipe which is run down into the well by a rotating kelly. The kelly has a hexagonally or polygonally shaped cross-section to facilitate rotation of it by a rotary table. To prevent the loss of drilling mud or well fluids, a rotating blowout preventer mounted between the rotary table and the wellhead engages a tight fluid seal about the kelly or drill pipe. The downward motion of the kelly or drill tool combined with the rotation of the kelly or tool subjects this fluid seal to vertical as well as radial loads. The fluid pressures in the well subject this seal to additional vertical loading.

Conventional stationary blowout preventers heretofore have employed a hydraulically operated wedging type piston to radially compress an annular packing about a production pipe to form a tight fluid seal capable of resisting the internal well pressure forces.

Heretofore, rotating blowout preventers have not been able to take advantage of a hydraulic wedging force to form a radially compressible tight fluid seal about a rotating drill pipe or irregularly shaped kelly during drilling operations. Prior blowout preventers such as the Jones rotating blowout preventer U.S. Pat. No. 3,492,007 have used only horizontal forces to radially compress an annular packing about a rotating drill pipe or kelly. The Shaffer device, U.S. Pat. No. 3,587,734 adds a rotatably mounted stripper seal to a conventional stationary blowout preventer to provide the necesary fluid seal rather than hydraulically wedging an annular packing about a rotating drill pipe or kelly.

The advantages of an oil well pipe seal engaged by a hydraulic wedging force are well known in the art. Furthermore, such a sealing method has been proven effective in the environment of stationary blowout preventers.

The primary object of this invention is to disclose and provide an effective, economical and simply constructed high pressure seal around a rotating drill pipe or kelly whose construction is also compatible with proven stationary blowout preventer components.

It is another object of this invention to utilize a conventional, radially compressible seal of known sealing capacity in a rotating blowout preventer, wherein the advantages of a radially compressible seal engaged by a hydraulic wedging force are obtained.

It is another object of this invention to construct a rotating blowout preventer from stationary blowout preventer components which are readily available and less expensive than custom made components.

It is a further object of this invention to disclose and provide an improved bearing support for a rotating blowout preventer.

SUMMARY OF THE INVENTION

Generally stated the rotary blowout preventer of this invention includes a housing and an elastomeric, annular packing adapted to be radially contracted about a drill pipe or kelly by peripherally applied, vertically upward and radially inward wedging forces, a packing contractor means to apply the wedging forces along with an actuating means for moving the packing contractor means and bearing means for rotatably mounting the packing contractor means relative to the actuating means whereby the packing is both radially contracted about a drilling pipe or kelly and rotatably mounted by the packing contractor allowing the packing to rotate with the drill pipe or kelly. In a preferred embodiment the packing contractor means includes an inverted, truncated cone rotatably seated by a plurality of bearing races on the conical wedging surface of a hydraulic piston which is included in the actuating means. A thrust bearing interposed between the packing and the housing is also contemplated in a preferred embodiment to allow for radial motion in the packing and to prevent upward axial motion of the packing.

DESCRIPTION OF THE PREFERRED EMBODIMENT

Figure 1:
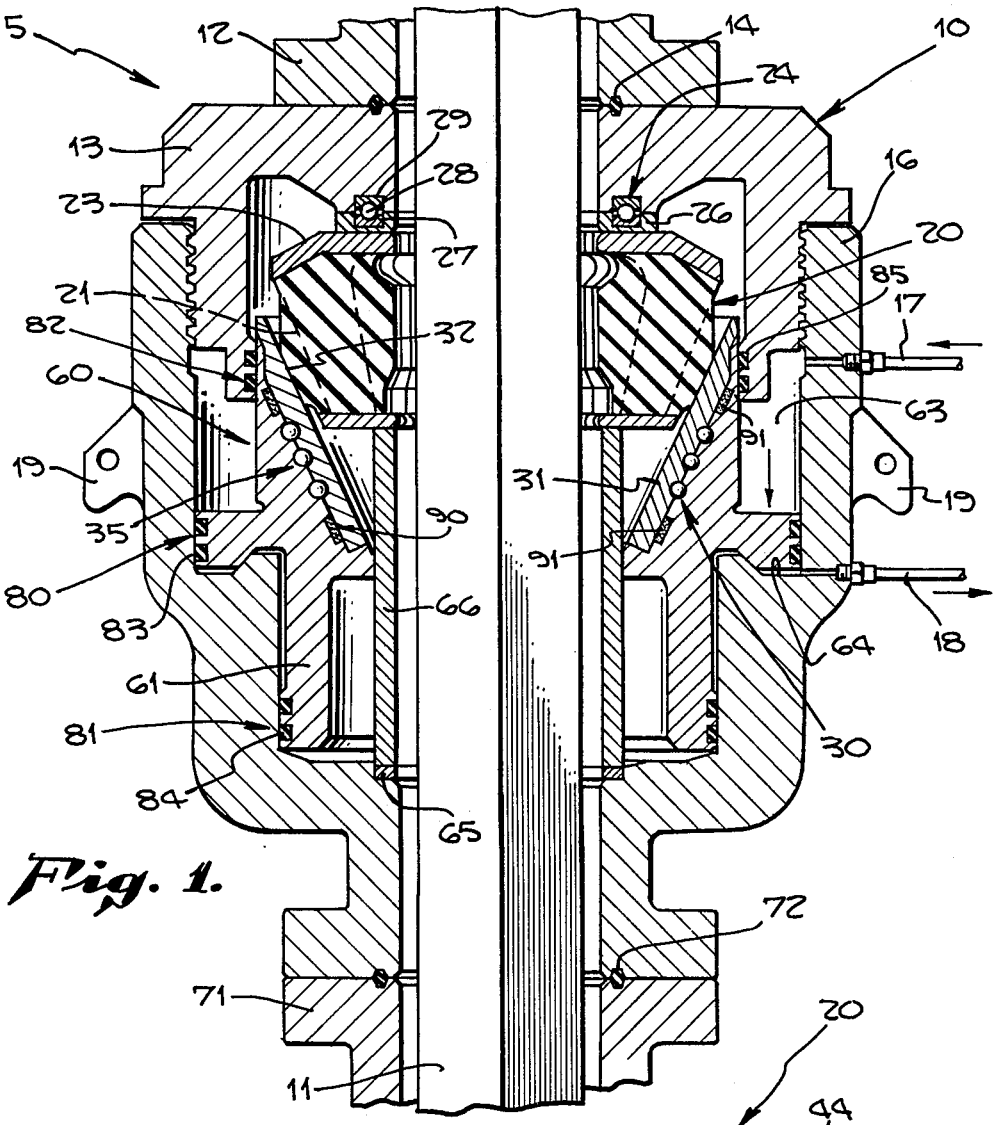
FIG. 1 is a vertical cross-sectional view through the preferred exemplary embodiment of a rotating blowout preventer in accordance with the present invention showing the rotatably mounted packing in the fully open position.

The preferred exemplary embodiment of a blowout preventer, indicated generally at 5, in FIG. 1 includes in general; a housing indicated generally at 10, a packing indicated generally at 20, a hydraulic actuating means indicated generally at 60 and a packing contractor means indicated generally at 30.

More particularly, the housing 10 in the exemplary embodiment includes an upper housing 13 and a lower housing 16 which may be conventionally screwed together. The upper housing 13 may be bolted or welded to the upper mounting flange 12. The lower housing 16 is similarly attached to the lower mounting flange 71. O ring type seals 14, 72 are provided between the housing 12 and 16 and the mounting flanges 12 and 71. Lifting brackets 19 on the exterior of the housing 10 enable the blowout preventer 5 to be positioned as desired by remote means.

The exemplary packing indicated generally at 20 is of conventional design and includes an elastomeric annular packing with metal reinforcing webs 21. The packing 20 contemplated within the present invention is to be radially compressed about a drill pipe or polygonally shaped kelly 11 to sealingly engage and thereby be rotated with said pipe or said kelly 11.

The exemplary actuating means indicated generally at 60, is also of conventional design and includes a hydraulic piston 61. The hydraulic piston 61 is positioned by the application of differential hydraulic pressures in the upper 63 and lower 64 hydraulic fluid chambers. A hydraulic pressure in the lower hydraulic chamber 64 which is higher than the hydraulic pressure in the upper hydraulic fluid chamber 63 will raise the piston 61. As contemplated within the present invention, the packing contractor means indicated generally at 30, is raised with said piston 61 and transmits a radially inward force to the packing 20 causing said packing 20 to close inward and seal about said drill pipe or said kelly 11. Conversely, if the pressure in the upper hydraulic fluid chamber 63 is higher than that of the lower hydraulic fluid chamber 64, the piston 61 and contractor means 30 will lower causing the packing 20 to move outward from the drill pipe or kelly 11. This allows the drill pipe or kelly 11 to be raised upward through the blowout preventer 5 to insert additional drill pipe. Hydraulic fluid enters and exits the chambers 63 and 64 via hydraulic lines 17 and 18.

As particularly contemplated within the present invention, a packing engaging and contracting element 31 and bearing means indicated generally at 35 are provided for rotatably mounting the packing engaging and contracting element 31 between said packing 20 and said hydraulic wedging piston 61. In this way the conventional packing 20 and piston 61 are adapted to provide the advantages of a rotary blowout preventer. The packing contractor means indicated generally at 30, as contemplated within the present invention, includes in the exemplary embodiment the packing engaging and contracting element 31 which provides an inverted, conical, rotating support engaging peripheral portions of said packing 20. Said element 31 is an inverted, truncated cone rotatably seated by bearing means indicated generally at 35 on the inverted, truncated conical wedging surface of said piston 62. The element 31 engages the packing 20 about its periphery at 32.

Figure 2:
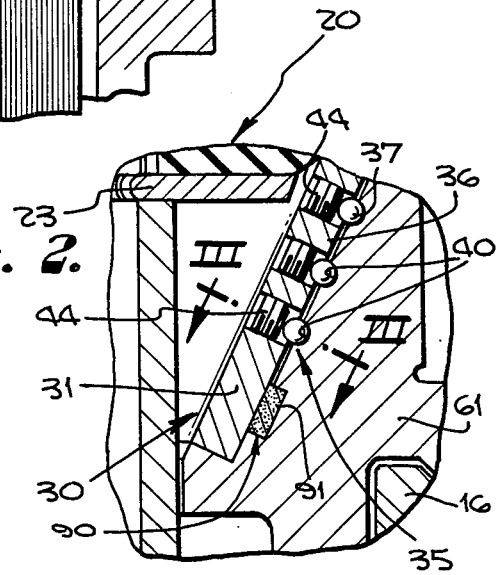
FIG. 2 is a detail view of the rotating blowout preventer of FIG. 1 showing the means for rotatably mounting the packing contractor means to the actuating means.
Figure 3:
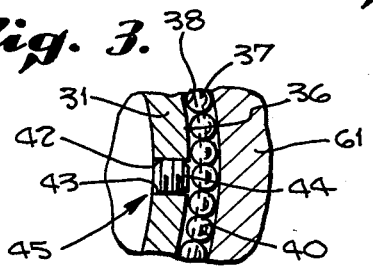
FIG. 3 is an enlarged cross-sectional detail view of the means for rotatably mounting the packing contractor means of FIG. 2 taken therein along the plane III—III.
Figure 5:
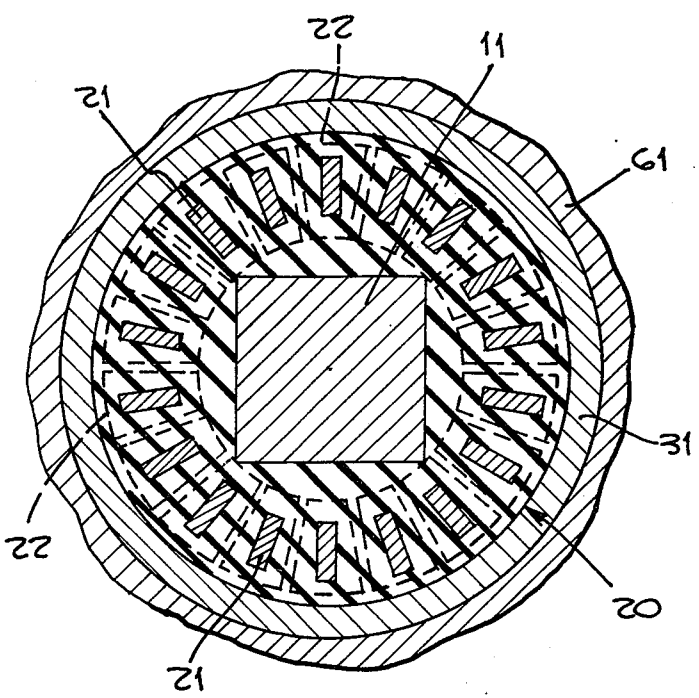
FIG. 5 is a cross-sectional detail view of the packing means of FIG. 4 taken therein along the plane V—V.
Figure 4:
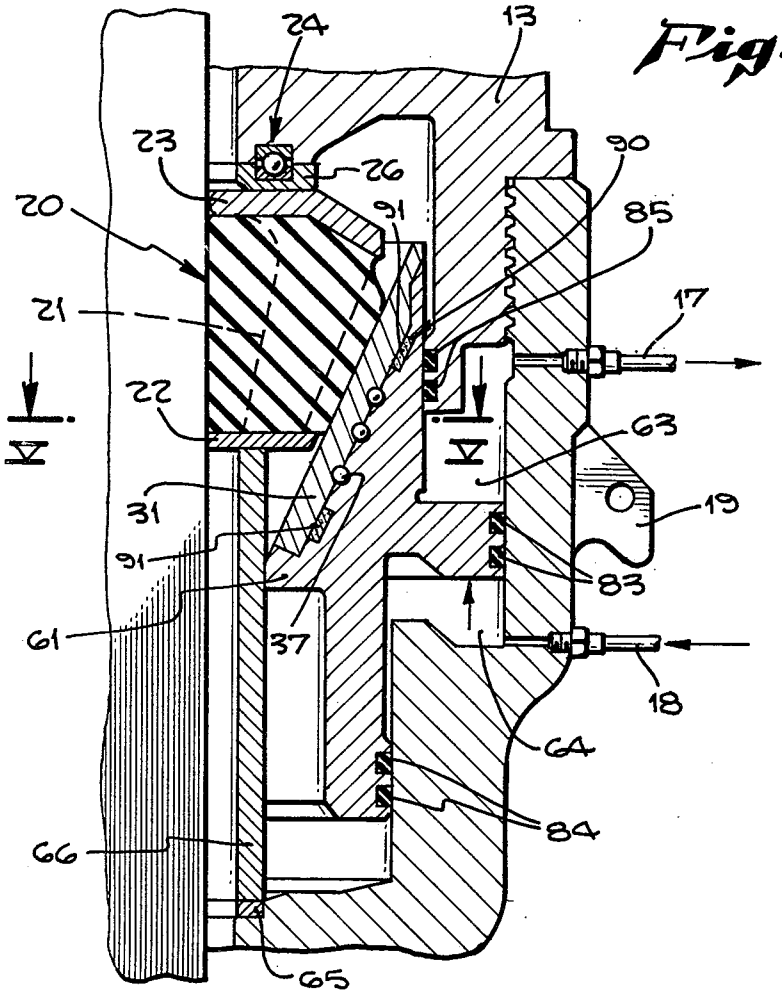
FIG. 4 is a partial view of the blowout preventer apparatus of FIGS. 1 through 3 showing the packing means in a closed position, about a kelly or drill pipe.

The exemplary bearing means indicated generally at 35, of FIGS. 1 and 2 comprises a plurality of ball bearing races 36 and ball bearings 37 therein provided between said packing contractor means 30 and said actuating means 60. However, the exemplary bearing means is not limited to ball bearings as this invention also contemplates the use of roller bearings in place of ball bearings because of the higher load bearing capability of roller bearings. FIG. 3 shows one such ball bearing race 38 and ball bearings 37. The outer ball bearing race groove 40 machined in the hydraulic wedging piston 61 aligns with the inner race groove 41 machined in the packing engaging and contracting element 31 to form the ball bearing race 38 when said element 31 is mounted to said piston 61. Aperture means indicated generally at 45, provides one access hole 42 per bearing race 38 through the packing engaging and contracting element 31. In the exemplary embodiment, each access hole 42 is provided by a drilled and tapped access bore 43 through said element 31, which is best seen in FIG. 3. An externally threaded plug 44 is conventionally screwed into said bore 43 to maintain the ball bearing 39 in proper position. The ball bearing races 36 permit the packing engaging and contracting element 31 to be rotated by the packing 20 relative to the piston 61.

The exemplary bearing means indicated generally 35 of FIG. 1 further comprises a thrust bearing 24 and bearing plate 26 interposed between said packing 20 and said upper housing 13 to allow for radial motion in said packing 20 and to prevent upward axial motion of said packing 20. The thrust bearing 24 in the exemplary embodiment comprises a circular upper bearing race groove 29 provided in said upper housing 13, a circular lower bearing race groove 27 provided in said bearing plate 26 and a plurality of ball bearings 28 in the circular ball bearing race 25 formed between said upper 29 and said lower 27 bearing race grooves. However, the exemplary bearing means is not limited to ball bearings as this invention also contemplates the use of roller bearings in place of ball bearings because of the higher load bearing capability of roller bearings. The thrust bearing 24 allows the packing 20 to rotate relative to the stationary housing 10. When the drilling pipe or kelly 11 is raised upward, the upper flanges of the packing metal reinforcing webs 23 engage the thrust bearing plate 26 preventing further upward axial motion of the packing 20.

Downward axial motion of the packing 20 is limited by the ported tubular support 66 which engages the lower flanges of the packing metal reinforcing webs 22. Said support 66 is held in place by the seal plate 65 which is rigidly fastened to the lower housing 16.

Sealing means indicated generally at 90 are provided between said element 31 and said piston 61 outboard of said bearing means 35 for encapsulating said bearing means 35. In the exemplary embodiment, O ring type seals 91 isolate the bearing means 35. Sealing means indicated generally at 80, 81 are provided between said piston 61 and said lower housing 16, for encapsulating hydraulic fluid in said piston chambers 63 and 64.

Sealing means indicated generally at 82 are also provided between said piston 61 and said upper housing 13 for further encapsulating hydraulic fluid in said piston upper piston chamber 63. In the exemplary embodiment, O ring type seals 83, 84 and 85 encapsulate the hydraulic fluid in said piston chambers 63, 64.

Having described in detail a preferred exemplary embodiment of the rotating blowout preventer contemplated with the present invention it is now apparent to persons skilled in the art that the present invention achieves a high pressure seal about a rotating drill pipe or kelly whose construction is compatible with conventional stationary blowout preventer components. Furthermore, the present invention obtains the advantages of a radially compressible seal engaged by a hydraulic wedging force utilizing conventional components normally found in stationary blowout preventers by virtue of the bearing means and packing contractor means indicated generally at 35 and 30, respectively. Additionally, the bearing means contemplated within the present invention and indicated generally at 35 provides an improved bearing support for rotating blowout preventers.

While a single preferred exemplary embodiment of the rotating blowout preventer according to the present invention has been described herein in detail, it is to be understood that this disclosure is intended to be exemplary only and is not intended to limit the scope of the invention which may include other embodiments, adaptations and modifications thereof made within the present invention as defined and limited only by the following claims.

I claim:

1. In a blowout preventer having a housing, a metal reinforced, elastomeric, annular packing and a hydraulic wedging piston the improvement comprising:

a packing engaging and contracting element and bearing means for rotatably mounting the packing engaging and contracting element between said packing and said hydraulic wedging piston.

2. The improvement in blowout preventer of claim 1 wherein said bearing means comprises:

a thrust bearing and bearing plate interposed between said packing and said housing to allow for radial motion in said packing and to prevent upward axial motion of said packing.

3. The improvement in blowout preventer of claims 1 wherein said piston includes an inverted, truncated conical wedging surface and said element comprises:

an inverted, truncated cone rotatably seated by said bearing means on said conical wedging surface of said piston.

4. The improvement in blowout preventer of claim 1 wherein said bearing means comprises:

a plurality of bearing inner race grooves machined in the packing engaging and contracting element;

a plurality of bearing outer race grooves machined in the hydraulic wedging piston; and a plurality of bearings in the bearing races formed between aligned pairs of said inner and outer race grooves when the packing engaging and contracting element is mounted to the hydraulic wedging piston.

5. The improvement in blowout preventer of claims 1, 2, 3 or 4 further comprising: sealing means provided between the packing engaging and contracting element and the hydraulic wedging piston outboard of said bearing means for encapsulating said bearing means.

6. The improvement in blowout preventer of claim 2 wherein said thrust bearing comprises:

a circular upper bearing race groove provided in said housing; a circular lower bearing race groove provided in said bearing plate; and a plurality of bearings in the circular bearing race formed between said upper and lower bearing race grooves.

7. The improvement in blowout preventer of claim 4 wherein said bearing means further comprises:

aperture means for providing one access hole per bearing race through the packing engaging and contracting element for insertion of bearing lubricants or for the insertion or removal of individual bearings; and a plug in each access hole, which is releasably attached to the packing engaging and contracting element.

8. A rotary blowout preventer having a housing and comprising:

an elastomeric, annular packing adapted to be radially contracted by peripherally applied vertically upward and radially inward forces;

packing contractor means for applying said forces;

actuating means for moving said packing contractor means vertically upward and radially inward;

bearing means for rotatably mounting said packing contractor means relative to said actuating means whereby said packing is both radially contracted about a drilling tool and rotatably mounted by said packing contractor allowing said packing to rotate with said drilling tool.

9. The rotary blowout preventer of claim 8 wherein said packing means includes metal reinforcing webs, the top flanges of which engage a thrust bearing and further comprises:

a circular bearing race interposed between said housing and the thrust bearing plate;

a plurality of bearings in said bearing race interposed between said housing and said thrust bearing plate.

10. The rotary blowout preventer of claim 8 wherein said bearing means comprises:

a plurality of bearing races and bearings therein provided between said packing contractor means and said actuating means; and sealing means provided between said packing contractor means and said actuating means outboard of said bearing races for isolating said bearing races.

11. The rotary blowout preventer of claim 10 wherein said plurality of bearing races are provided by:

a plurality of bearing inner race grooves provided in said packing contractor means;

a plurality of bearing outer race grooves provided in said actuating means;

pairs of said inner and outer race grooves when said packing contractor means is rotatably mounted to said actuating means.

12. The method of sealing about a rotating oil well tool passing through a blowout preventer apparatus having a housing, a radially compressible packing and a hydraulic wedging piston comprising the steps of:

providing an inverted, conical support engaging peripheral portions of said packing;

rotatably mounting said support on said hydraulic wedging piston; and radially compressing said packing to sealingly engage, and thereby be rotated with, said tool by raising said piston with said support engaging said packing and being rotatably mounted on said piston.

13. The method of claim 12 wherein said method step of radially compressing includes the further method steps of:

rotatably mounting said support on a conical shaped wedging surface of said hydraulic piston by bearing means interposed between said support and said piston; and applying hydraulic forces to said piston to raise said support.

14. In a blowout preventer having a housing, a metal reinforced, elastomeric, annular packing and a hydraulic wedging piston the improvement comprising:

a packing engaging and contracting element and bearing means for rotatably mounting the packing engaging and contracting element between said packing and said hydraulic wedging piston, wherein said bearing means comprises a thrust bearing and bearing plate interposed between said packing and said housing to allow for radial motion in said packing and to prevent upward axial motion of said packing, wherein said piston includes an inverted, truncated conical wedging surface and said element comprises an inverted, truncated cone rotatably seated by said bearing means in said conical wedging surface of said piston.

* * * * *